US006258406B1

(12) United States Patent
Enders et al.

(10) Patent No.: US 6,258,406 B1
(45) Date of Patent: Jul. 10, 2001

(54) GODET FOR APPLYING A LIQUID TO AN ADVANCING YARN AND METHOD OF USING SAME

(75) Inventors: Ulrich Enders, Remscheid; Markus Reichwein, Huckeswagen, both of (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/308,990

(22) PCT Filed: Sep. 22, 1998

(86) PCT No.: PCT/EP98/06029

§ 371 Date: May 27, 1999

§ 102(e) Date: May 27, 1999

(87) PCT Pub. No.: WO99/16948

PCT Pub. Date: Apr. 8, 1999

(30) Foreign Application Priority Data

Sep. 27, 1997 (DE) ..... 197 42 789

(51) Int. Cl.[7] ..... B05D 1/28; B05C 1/10

(52) U.S. Cl. ..... 427/175; 427/428; 427/429; 118/264; 118/266; 492/17; 57/295

(58) Field of Search ..... 226/190; 57/295; 492/17; 427/428, 429, 175; 118/264, 266

(56) References Cited

U.S. PATENT DOCUMENTS 4,773,136 * 9/1988 Seydel et al. ..... 28/179

FOREIGN PATENT DOCUMENTS

| | | | |
|---|---|---|---|
| 879 582 | | 2/1980 | (BE) . |
| 2 317 053 | | 7/1974 | (DE) . |
| 29 08 404 | | 10/1985 | (DE) . |
| 41 13 339 | | 10/1992 | (DE) . |
| 43 33 716 | | 2/1995 | (DE) . |
| 0 173 432 | | 3/1986 | (EP) . |
| 2 064 604 | * | 6/1981 | (GB) . |

OTHER PUBLICATIONS

Patent Abstracts of Japan, vol. 5, No. 156 (C–074), Oct. 6, 1981 & JP 56 085410 A (Toyobo Co Ltd), Jul. 11, 1981.

* cited by examiner

*Primary Examiner*—Katherine A. Bareford
(74) *Attorney, Agent, or Firm*—Alston & Bird LLP

(57) ABSTRACT

A device and method for applying a liquid to at least one advancing yarn which is guided over a surface of a driven godet in contact therewith. A liquid is supplied through a plurality of capillaries to the surface. To this end, the pore-sized openings of the capillaries are evenly distributed on the godet surface being wetted.

20 Claims, 4 Drawing Sheets

GODET FOR APPLYING A LIQUID TO AN ADVANCING YARN AND METHOD OF USING SAME

CROSS REFERENCE TO RELATED APPLICATION

This is a national phase application of PCT/EP 98,/06029, filed Sep. 22, 1998.

BACKGROUND OF THE INVENTION

The present invention relates to a godet for applying a liquid to an advancing yarn wherein the yarn is advanced over the outer surface of the godet as the godet rotates about its axis and wherein the liquid is applied in measured quantities to the surface of the godet so as to be applied to the yarn.

DE 29 08 404 discloses a method and an apparatus for applying a liquid to an advancing yarn. The apparatus is formed by a driven godet, which comprises radially peripheral surface areas that can be wetted. A metering device applies the liquid for lubricating the yarn in measured quantities to the surface of the godet. The yam advances over the wetted surfaces in contact therewith and thus receives its coating of the lubricant.

This known method has the disadvantage that the liquid made available on the surface for lubricating the yam decreases as the circumferential speed of the godet increases. Thus, a slowly advancing yarn is offered a relatively large quantity of liquid and a fast advancing yarn a relatively small quantity of liquid. Consequently, fast advancing yarns at a speed greater than 3,000 m/min can be lubricated by this method only inadequately.

DE 43 33 716 discloses a method and an apparatus, wherein the godet surface comprises a groove. In this groove, a liquid for lubricating a yarn is sprayed from the outside. For the lubrication, the advancing yarn is guided over the groove of the godet. Likewise, this method shows the tendency that a small amount of liquid is offered to a relatively fast advancing yarn for its lubrication.

It is therefore the object of the invention to improve a method and an apparatus of the initially described kind, so that they ensure a uniform lubrication of a yarn regardless of its speed.

SUMMARY OF THE INVENTION

The above and other objects and advantages of the present invention are achieved by the provision of a godet which defines a cylindrical outer surface, and which includes a plurality of substantially radially oriented capillaries formed in the godet and communicating with the outer surface so as to define openings on the outer surface which are distributed circumferentially thereabout. Also, a liquid supply device is connected to the capillaries for supplying a liquid to the capillaries and thus to the openings on the outer surface.

In use, the liquid is metered onto the outer surface of the godet through the capillaries and openings, and the openings are distributed over the surface of the godet. Thus, metering of the liquid is determined by the diameters of the capillaries, the number of the capillaries, as well as the rotational speed of the godet. By merely increasing the rotational speed of the godet and, thus, the surface speed, the quantity of the liquid emerging from the capillaries increases. With that, it is possible to use the method as well as the apparatus even at higher yarn speeds of more than 3,000 m/min without subjecting the lubrication effect to a change.

To lubricate one or more yarns, it is preferred to drive the godet by a motor. However, both the method and the apparatus of the present invention also offer the possibility of constructing the godet without a drive. In this instance, the yarn or yarns drive the godet. A speed control would here be possible, for example, by means of an adjustable brake. The metering is directly determined by the yarn speed. Thus, due to the centrifugal force at high yarn speeds and, with that, at high circumferential speeds of the godet, a larger quantity of liquid is present on the surface of the godet that is contacted by the yarn.

A further advantage of the invention lies in that the liquid emerging from the surface distributes very evenly over the surface. This permits metering the liquid that is applied to the yarn.

Likewise, the path of the advancing yarn never dries, since the liquid is constantly supplied to the yarn even from the bottom.

The method will be especially advantageous and efficient, when the liquid is supplied to the capillaries inside the godet. The liquid is guided without losses to the surface of the godet. The transfer into the capillaries occurs alone due to the centrifugal forces.

The capillaries extend in the surface areas that serve to lubricate the yarn. However, it will be especially advantageous, when the pore-sized openings of the capillaries are evenly distributed over the entire surface on the circumference of the godet. With that, it is possible to realize a very uniform lubrication in that the yarn loops about the godet several times. In particular, in the case of low yarn speeds, it will be possible to lubricate therewith several, parallel guided yarns at the same time. To this end, the yarns advance over the godet parallel with a multiple looping.

The variant of the method, wherein the capillaries are formed in a sleeve that is slipped over the godet casing distinguishes itself in particular in that a varied metering is to be realized in a simple manner irrespective of the rotational speed of the godet. In this connection, a sleeve slipped over the godet casing may be replaced with a second sleeve having differently configured capillaries.

To obtain a great evenness of the capillaries, it will be especially advantageous to make the sleeve of a sintered material.

To lubricate several yarns evenly with one godet, the variant of the method is especially advantageous, wherein the yarn advances with a partial looping on the godet circumference. To this end, in one embodiment of the apparatus according to the invention the pore-sized openings of the capillaries are evenly arranged within a plurality of parallel juxtaposed, radially peripheral surface areas of the godet casing or sleeve. Each of the surface areas forms a path for wetting a yarn.

In a particularly advantageous embodiment of the apparatus according to the invention, the liquid supply to the capillaries in the sleeve proceeds through a plurality of grooves arranged in the godet surface that is covered by the sleeve. In this connection, the grooves may be formed in the godet surface radially, axially or spirally. The grooves connect to the liquid supplying device, so that the liquid required for lubricating the yarn is continuously present within the groove.

The diameters of the capillaries, the number of capillaries, as well as the rotational speed of the godet determine the amount of liquid available on the surface for lubricating the yarn. The diameter of the capillaries that is selected as a function of the yarn denier is preferably in a range from 10

μm to 1,000 μm. In this connection, a number of capillaries are selected that covers from minimally 2% to maximally 75% of the surface.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENTS

Figure 1:
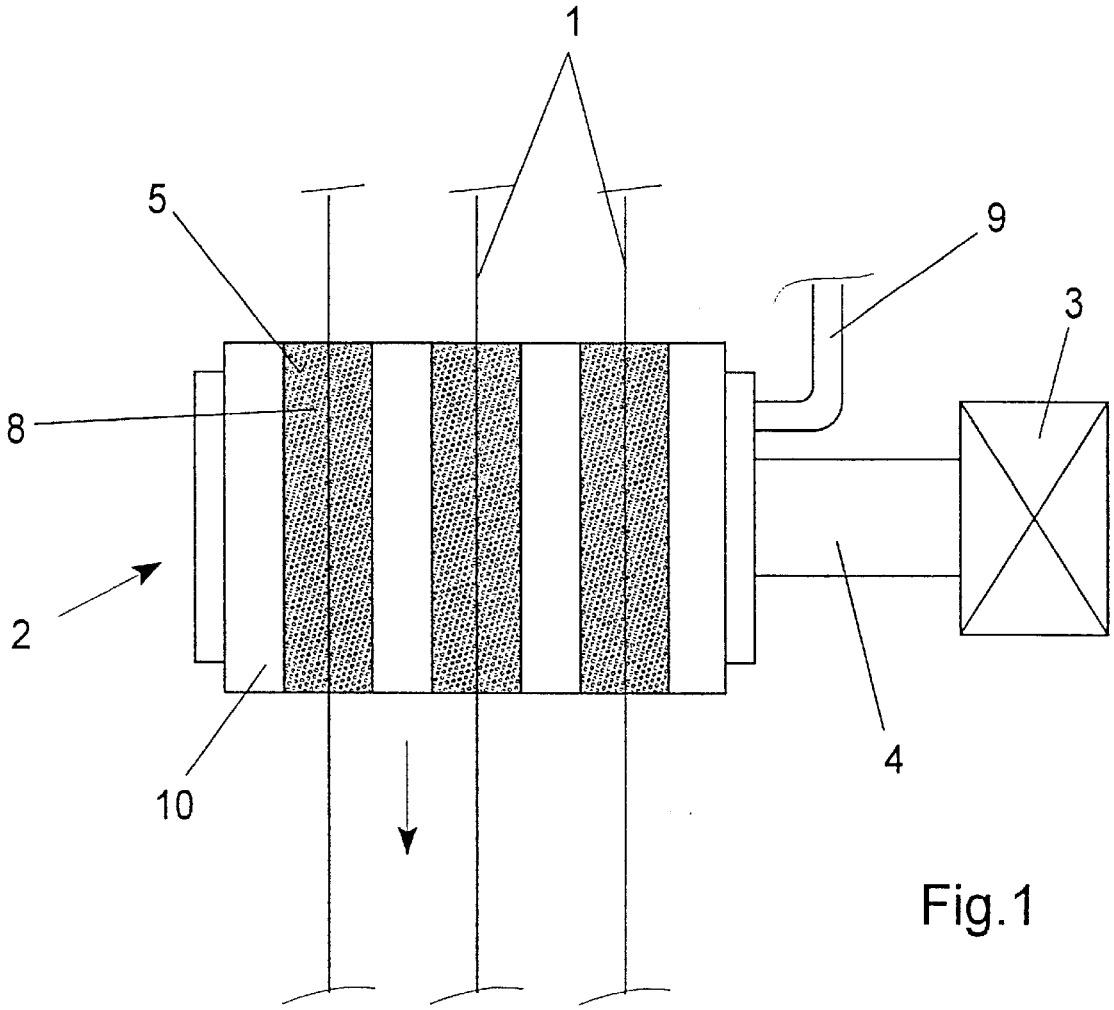
FIG. 1 shows an apparatus of the present invention for applying a liquid to a plurality of advancing yarns.

FIG. 1 illustrates a first embodiment of an apparatus for applying a liquid to a plurality of advancing yarns. The apparatus consists of a godet 2 that connects to a drive shaft 4. A godet drive 3 drives the shaft 4 in such a manner that the godet surface moves in the direction of the advancing yarn, as is indicated by an arrow. A sleeve 10 is securely slipped over the circumference of godet 2. The sleeve 10 comprises a plurality of parallel juxtaposed, radially peripheral surface areas 5. The surfaces 5 contain a plurality of substantially evenly distributed, pore-sized openings 8, which are formed by a corresponding number of capillaries 6 that extend substantially radially into the sleeve 10.

Figure 2:
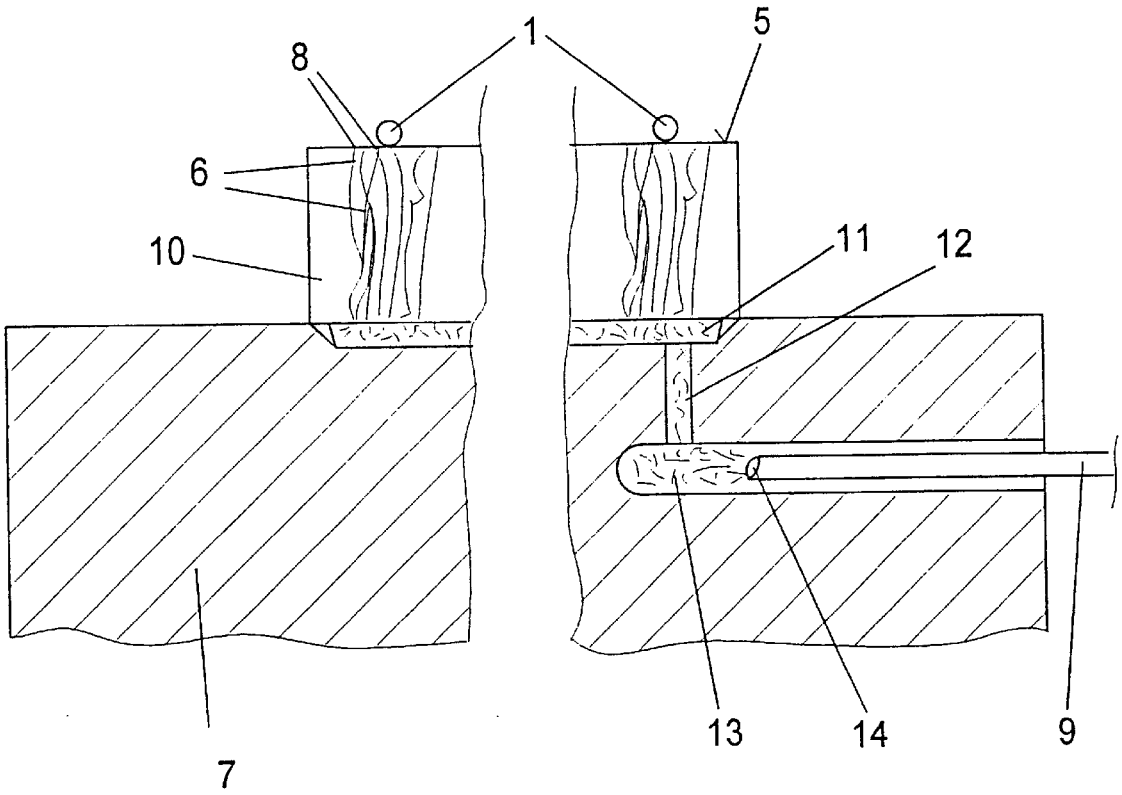
FIG. 2 is a schematic, cross sectional view of the casing of the godet of FIG. 1.

The godet 2 connects to a liquid supplying device 9. FIG. 2 is a schematic, cross sectional view of the godet of FIG. 1. The liquid supplying device 9 constructed as a tube extends into an axially directed annular groove 13 that is formed in godet casing 7, and which is radially offset from the central axis of the godet. The annular groove 13 is arranged for rotation in godet casing 7. The liquid supplying device comprises an outlet 14 at the end of the tube portion that extends into the annular groove 13. The outlet 14 is arranged in the vicinity of the internal end of annular groove 13. At the internal end of the annular groove 13 inside the godet casing 7, a plurality of radial bores 12 arranged in a normal plane are provided. The bores 12 connect the annular groove 13 to a plurality of grooves 11 arranged in the surface of godet casing 7. The sleeve 10 covers the grooves 11. A plurality of capillaries 6 extend in the radial direction through the sleeve 10. The capillaries 6 represent a connection between the grooves 11 and the surface 5 of sleeve 10. Yarns 1 contact the surface 5.

To lubricate yarns 1, the godet is driven by godet drive 3. In this connection, it is preferred to adjust the surface speed such that it is equal to the speed of the advancing yarn. However, it is also possible to generate a relative speed between the yarn 1 and the surface 5. At the same time, the annular groove 13 receives via liquid supplying device 9 the liquid that is required for lubricating the yarn. From the annular groove 13, the liquid flows due to the centrifugal force through bores 12 to the grooves 11. Subsequently, the liquid enters from grooves 11 into the capillaries 6 of sleeve 10, and reaches through capillaries 6 the surface 5. On the surface 5, the liquid is picked up by the yarn 1 respectively advancing thereover. Besides the rotational speed of the godet, the amount of liquid emerging from the surface 5 is dependent on the number of capillaries as well as their size.

In the apparatus shown in FIGS. 1 and 2, the sleeve 10 is exchangeable. By exchanging sleeves 10 with respectively differently shaped capillaries, it is possible to vary the metering of the liquid.

The surface areas contacted by the yarn have a roughness from Rz 2.4 to Rz 10, so that even higher loopings are possible for applying the liquid.

Figure 3:
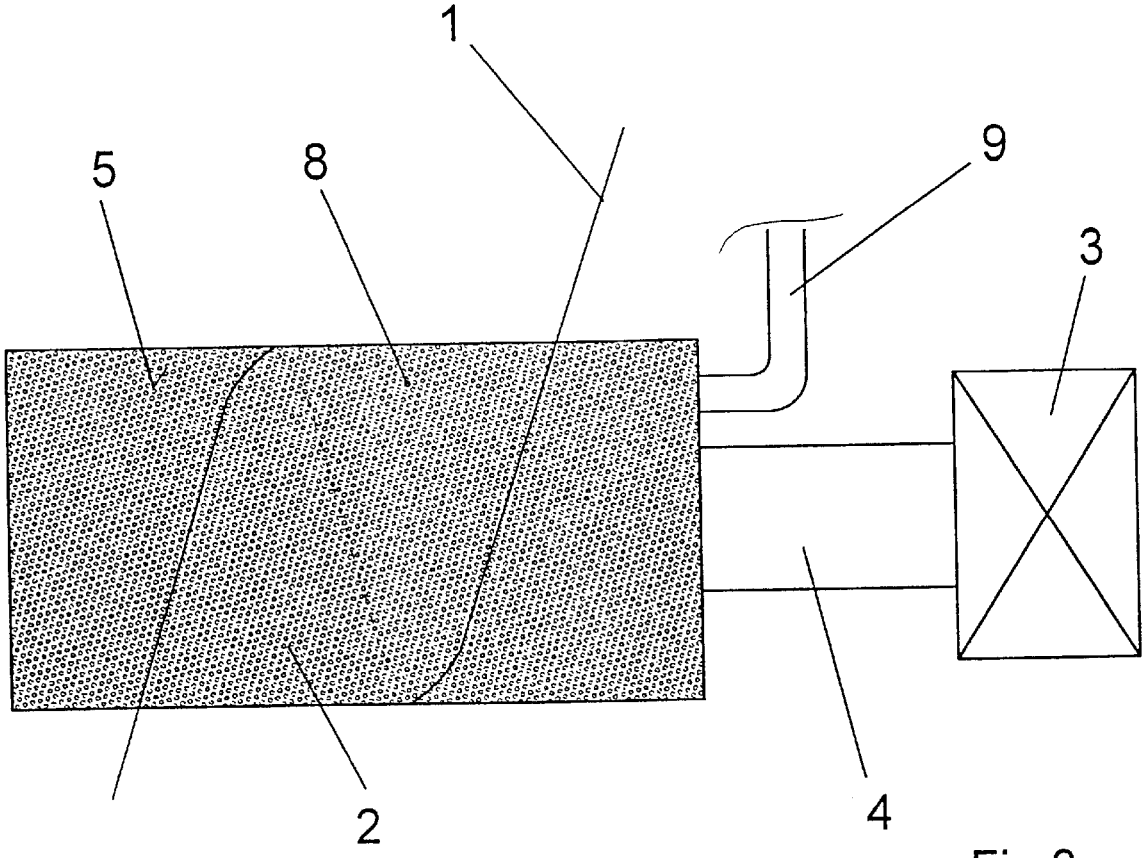
FIG. 3 shows an apparatus of the present invention for lubricating an advancing yarn.

FIG. 3 shows an apparatus, wherein a yarn 1 is lubricated by looping several times about a godet 2. In its construction, the apparatus of FIG. 3 is similar to that of FIG. 1. To this extent, the description of FIGS. 1 and 2 is herewith incorporated by reference.

Figure 4:
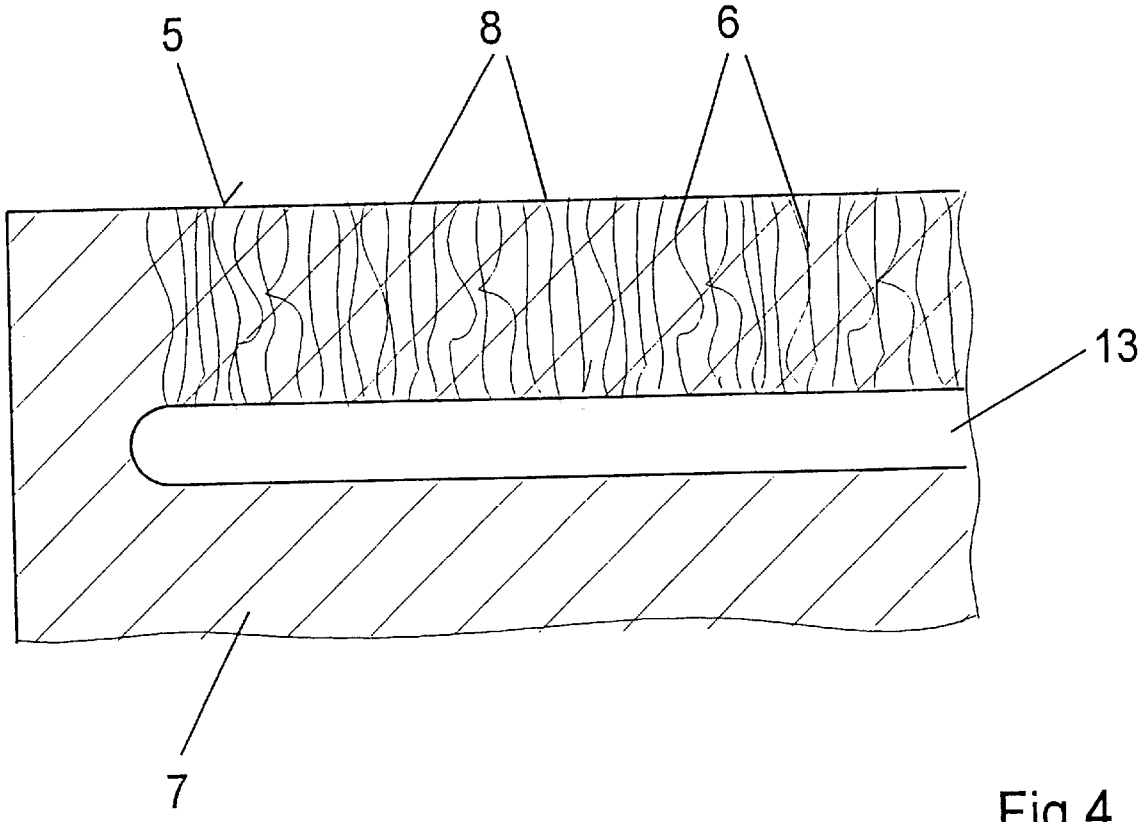
FIG. 4 is a schematic, cross sectional view of the casing of the godet of FIG. 3.

Unlike the embodiment of FIG. 1, FIG. 3 shows a godet 2, wherein the pore-sized openings 8 of the capillaries 6 are evenly distributed over the entire surface 5 of godet casing 7. As shown in FIG. 4, the capillaries 6 are directly provided in the godet casing 7. In this embodiment, the capillaries 6 terminate in the annular groove 13 within godet casing 7. The annular groove 13 in godet casing 7 connects again to the liquid supplying device 9. Thus, the liquid arrives from the annular groove 13 through the capillaries 6 at the godet surface 5. The godet surface 5 is therefore evenly wetted with the liquid over the entire area, thereby permitting a uniform lubrication of yarn 1.

A sintered material may advantageously produce the capillaries in sleeve 10 as well as in godet casing 7. However, it is also possible to use other porous, permeable materials for forming the capillaries in the godet casing.

A further possibility consists in working capillaries as bores into a metallic surface, for example, by laser beams.

What is claimed is:

1. A method of applying a liquid to an advancing yarn comprising the steps of providing a godet which defines a cylindrical outer surface and a central axis, and a plurality of substantially radially directed capillaries formed in the godet and communicating with the outer surface so as to define openings on the outer surface which are distributed circumferentially thereabout, with the capillaries having a diameter ranging between about 10 μm and 1000 μm, and with the godet being mounted for rotation about said central axis, and a liquid supply system comprising an annular groove extending axially into said godet and being radially offset from the central axis of the godet, with the annular groove communicating with said capillaries, guiding the advancing yarn into contact with the outer surface of the godet while causing the godet to rotate about said central axis, and while metering a liquid into the annular groove and through the capillaries and openings and onto the outer surface of the godet and so that the liquid is applied to the advancing yarn.

2. The method as defined in claim 1, wherein the godet is caused to rotate by its contact with the advancing yarn.

3. The method as defined in claim 1, wherein the godet is caused to rotate by a drive motor, and wherein the direction of the advancing yarn corresponds to the direction of rotation of the outer surface of the godet at the location where the advancing yarn engages the outer surface.

4. The method as defined in claim 1, wherein the liquid is supplied to the capillaries from within the godet.

5. The method as defined in claim 1, wherein the openings defined by the capillaries are substantially uniformly arranged on the entire outer surface of the godet.

6. The method as defined in claim 1, wherein the godet comprises a godet casing, and a sleeve mounted coaxially upon the godet casing, and wherein the sleeve defines said cylindrical outer surface and the capillaries are disposed in said sleeve.

7. The method as defined in claim 6, wherein the sleeve is formed of a sintered material.

8. The method as defined in claim 1, wherein the godet comprises a godet casing, and wherein the casing defines said cylindrical outer surface and the capillaries are disposed in said casing.

9. The method as defined in claim 1, wherein the guiding step includes at least partially looping the advancing yarn about the circumference of the outer surface of the godet.

10. The method as defined in claim 1, wherein the guiding step includes looping the advancing yarn at least once about the circumference of the outer surface of the godet.

11. A device for applying a liquid to at least one advancing yarn comprising a godet defining a cylindrical outer surface and a central axis, a plurality of substantially radially oriented capillaries formed in the godet and communicating with the outer surface so as to define openings on the outer surface which are distributed circumferentially thereabout, with the capillaries having a diameter ranging between about 10 $\mu$m and 1000 $\mu$m, and a liquid supply system connected to the capillaries for supplying a liquid to the capillaries and thus to the openings on the outer surface, said liquid supply system including an annular groove extending axially into said godet and being radially offset from the central axis of the godet.

12. The device as defined in claim 11, wherein the godet comprises a godet casing, and a sleeve mounted coaxially upon the godet casing, and wherein the sleeve defines said cylindrical outer surface and the capillaries are disposed in said sleeve.

13. The device as defined in claim 12, wherein the liquid supplying system includes a plurality of grooves arranged between the godet casing and the sleeve.

14. The device as defined in claim 12, wherein the sleeve comprises a sintered material.

15. The device as defined in claim 12, wherein said sleeve is removably mounted on said godet casing so as to permit a second sleeve having capillaries of a configuration different from those of the first mentioned sleeve to be mounted on said godet casing.

16. The device as defined in claim 11, wherein said godet comprises a godet casing which defines said cylindrical outer surface, and wherein the capillaries are disposed in said casing.

17. The device as defined in claim 11, wherein the openings defined by the capillaries are substantially uniformly arranged on the entire outer surface of the godet.

18. The device as defined in claim 11, wherein the openings defined by the capillaries are substantially uniformly arranged within each of a plurality of axially spaced apart regions of the outer surface of the godet.

19. The device as defined in claim 11, wherein the liquid supplying system includes an internal passage defined within the godet.

20. The device as defined in claim 11 wherein the annular groove communicates with a transverse end of the godet at a location radially offset from the central axis of the godet and wherein the liquid supply system further comprises a liquid supply tube which extends axially through the transverse end of the godet and into said annular groove.

* * * * *